US008424936B2

(12) United States Patent
Müller et al.

(10) Patent No.: US 8,424,936 B2
(45) Date of Patent: Apr. 23, 2013

(54) OUTER DOOR GRIP, IN PARTICULAR FOR VEHICLES

(75) Inventors: Ulrich Müller, Velbert (DE); Marion Kilian, Velbert (DE); Dirk Müller, Essen (DE)

(73) Assignee: HUF Hülsbeck & Fürst GmbH & Co. KG, Velbert (DE)

( * ) Notice: Subject to any disclaimer, the term of this patent is extended or adjusted under 35 U.S.C. 154(b) by 728 days.

(21) Appl. No.: 12/459,031

(22) Filed: Jun. 26, 2009

(65) Prior Publication Data

US 2010/0225127 A1 Sep. 9, 2010

(30) Foreign Application Priority Data

Jun. 27, 2008 (DE) ..... 10 2008 030 126
Jul. 24, 2008 (DE) ..... 10 2008 034 460

(51) Int. Cl.
*E05B 3/00* (2006.01)
*E05C 3/00* (2006.01)

(52) U.S. Cl.
USPC ..... 292/336.3

(58) Field of Classification Search ..... 292/336.3, 292/DIG. 22, DIG. 65
See application file for complete search history.

(56) References Cited

U.S. PATENT DOCUMENTS

| | | | | |
|---|---|---|---|---|
| 5,669,642 | A * | 9/1997 | Kang | 292/336.3 |
| 6,471,262 | B1 * | 10/2002 | Schwab | 292/336.3 |
| 6,575,508 | B2 * | 6/2003 | Stuart et al. | 292/336.3 |
| 7,163,240 | B2 * | 1/2007 | Odahara | 292/347 |
| 7,201,405 | B2 * | 4/2007 | Le et al. | 292/93 |
| 7,210,716 | B2 * | 5/2007 | Mueller et | 292/336.3 |
| 7,478,848 | B2 * | 1/2009 | Kim | 292/336.3 |
| 7,635,151 | B2 * | 12/2009 | Rodawold et al. | 292/336.3 |
| 8,029,032 | B1 * | 10/2011 | Yang | 292/336.3 |
| 8,167,342 | B2 * | 5/2012 | Bertolotti | 292/336.3 |
| 2005/0184537 | A1 * | 8/2005 | Le et al. | 292/336.3 |
| 2008/0136199 | A1 | 6/2008 | Kim | |
| 2010/0237633 | A1 * | 9/2010 | Jankowski et al. | 292/216 |
| 2010/0276949 | A1 * | 11/2010 | Chang et al. | 292/336.3 |

FOREIGN PATENT DOCUMENTS

| | | |
|---|---|---|
| DE | 19803871 | 8/1999 |
| DE | 19806790 | 8/1999 |

* cited by examiner

*Primary Examiner* — Carlos Lugo
*Assistant Examiner* — Mark Williams
(74) *Attorney, Agent, or Firm* — Horst M. Kasper

(57) ABSTRACT

The invention concerns an outer door grip, in particular for vehicles. The outer door grip exhibits a handle (10), which can operate a lock disposed in the door upon actuation. The outer door grip exhibits a pivotal blocking member (20), which is normally placed in its ineffective release position (21) and therewith enables actuation of the handle (10). The blocking member (20) passes into an effective blocking position (22.1, 22.2) based on the inertia of the mass of the blocking member (20) in case of a crash, whereby the handle (10) becomes blocked. The blocking member (20) has available two blocking positions (22.1, 22.2), wherein the blocking member (20) moves into the first blocking position (22.1) upon a crash out of a first direction (30.1) and wherein the blocking member (20) moves into the second blocking position (22.2) upon a crash out of a second direction (30.2) located opposite to the first direction (30.1). A blocking lever (40) is furnished which is intermediately switched in the blocking position (22.1, 22.2) of the blocking member (20). The blocking lever (40) is thereby guided in a kind of connecting link guide (41).

8 Claims, 9 Drawing Sheets

OUTER DOOR GRIP, IN PARTICULAR FOR VEHICLES

BACKGROUND OF THE INVENTION

1. Field of the Invention

Figure 1:
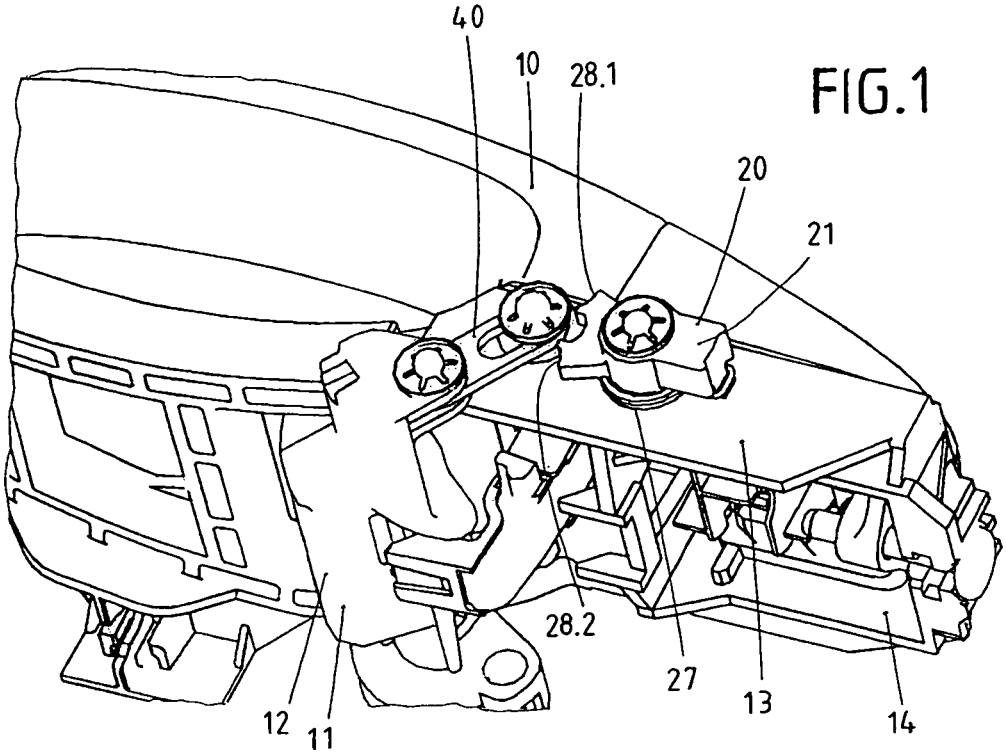

The invention relates to an outer door grip, in particular for vehicles, with a manually actuatable handle, wherein the handle upon activation can interact with a lock disposed in a door and with a pivotal blocking member, which is disposed normally in an ineffective release position and therewith allows to actuate the handle, which however based on the inertia of its mass passes into an effective blocking position in case of a crash and therewith blocks the handle, wherein two blocking positions are available to the blocking member, and wherein the blocking member passes into a first blocking position in case of a crash from a first direction and wherein the blocking member passes into a second blocking position in case of a crash from a second direction disposed opposite to the first direction.

2. Brief Description of the Background of the Invention Including Prior Art

Such outer door grips are used in a variety of ways. In case of a crash, in particular with a heavy side impact, it is to be avoided that the handles of the vehicle doors swivel toward the outside through the released forces and therewith open the vehicle doors. Thereby the danger would exist, that the vehicle passengers or objects present in the vehicle would be thrown out of the vehicle. Therefore pivotal blocking members are proposed in the state-of-the-art, which blocking members would be deflected based on the inertia of their mass prior to an occurrence of a deflection of the handle, and which blocking members then would block an effective actuation of the handle and would avoid an undesirable opening of the vehicle doors in this manner.

For example, the European patent document EP 1050640 A2 describes such a mass blockage. An outer door grip for vehicles is described here, wherein the outer door grip includes a pendulum like blocking member. In case of a side impact, this blocking member is deflected and thereby prevents an effective actuation of the handle. It is however a disadvantage in this arrangement that different devices have to be furnished for the different doors in the vehicle, for example driver door and co-driver door, since the blocking of the motion of the outer door grip is performed in only a single direction. In addition, the blocking member can prevent the unintentional opening of the door only in case of accidents with essentially the same crash direction. If the crash occurs from a direction, which is opposite to the optimum direction for which the device was laid out, then an unintentional opening of the door, for example caused by oscillations of the handle generated by the crash, cannot be prevented.

A similar problem also results with the outer door grip described in the German printed patent document DE 19929022 A1. Here again a pivotable blocking member is furnished, which blocking member is deflected in case of a crash and prevents then an unintentional actuation of the handle. Here again a separate device has to be furnished for each vehicle side. The blocking member does not prevent the unintentional actuation of the handle through a crash from a direction opposite to the optimum crash angle, caused for example by vibrations generated in the crash.

SUMMARY OF THE INVENTION

1. Purposes of the Invention

Therefore it is an object of the present invention to create an outer door grip of the initially recited kind, which outer door grip can be employed at all doors of the vehicle and which outer door grip prevents an unintentional opening of the vehicle door through a crash from the most different directions.

2. Brief Description of the Invention

This object is obtained by having the blocking member in its blocking position block the handle under intermediate switching and positioning of a blocking lever and by guiding the blocking lever in the kind of a connecting link guide.

The blocking member has available two blocking positions. The blocking member passes based on the inertia of its mass into a first blocking position through the deflection caused by the crash in case of a crash out of a first direction. The blocking member is deflected in a different direction and passes this way into a second blocking position if however the crash occurs from a second direction which is at least in part approximately opposite to the first crash direction. This is associated with the advantage that an unintentional opening of the door is avoided, independent of the direction from which the crash occurs. Also an unintentional actuation of the handle and a therewith associated opening of the door through the vibrations caused through the impact of the crash are prevented. In addition, it is possible to furnish an outer door grip which can be mounted on all doors, in particular on the two sides of the vehicle, and which nevertheless does justice to the requirements of crash safety. This is more cost advantageous in the production and also saves costs for storing. The blocking member blocks according to the present invention the handle under intermediate switching and positioning of a blocking lever. This blocking lever is guided in a connecting link guide and is moved together with the normal actuation of the handle. However just this motion of the blocking lever is prevented by the blocking member in case of a crash, thereby also the handle cannot be moved and the door does not open unintentionally. A good point of attack for the blocking member is provided in its blocking position by way of the intermediate switching and positioning of the blocking lever. The connecting link guide furnishes a simple and error insensitive possibility of actuation and motion of the blocking lever.

It is particularly advantageous when it is provided that the blocking member is moved to a small extent in case of a normal actuation of the handle. Since the blocking member is rarely in action naturally, it could occur on the other side that the blocking member seizes or, respectively, becomes clamped or that the surfaces corrode. A safe functioning of the blocking member is not any longer assured in a then occurring case of a crash in such a situation. This seizing is avoided by the comparatively frequent light actuation of the blocking member. Therefore, the blocking member is ready for use over the complete lifetime of the vehicle.

According to a preferred embodiment example, the blocking lever is connected to an element, which element also moves together with an activation of the handle, the so-called co-moving element or lot element. It is particularly advantageous to employ that co-moving element for the attachment of the blocking lever, which co-moving element also transfers the motion of the handle to the lock and thereby the actuation of the handle enables an opening of the door at all. The transfer of the motion to the lock occurs frequently by way of a Bowden cable or also with the aid of a rod. However is also possible to furnish one or more mass balancing weights, which take care of the mass balancing in the case of a crash. Since the mass balancing weights are usually elements, which are moved together with the actuation of the handle, these elements offer themselves also as co-moving elements, and at which elements the blocking lever can be attached.

In contrast to this, the blocking member should be placed at a fixed element, which does not move upon actuation of the handle. Here for example, a bearing bow or a grip support offer themselves as fixed elements. These device components are usually present with an outer door grip, since they serve the purpose of attaching and supporting the door grip in the door.

According to a preferred embodiment, the blocking member is spring loaded, wherein the spring load takes care that the blocking member remains in its release position in the standard situation. It is thereby avoided on the one hand that the blocking member becomes deflected from its release position into one of its blocking positions through standard motions of the vehicle, for example upon driving around a curve, and that an actuation of the handle and therewith an opening of the door is not any longer possible. It is also important that after an occurrence of a crash, persons can open the vehicle door from the outside in order to liberate for example injured vehicle passengers or children from the vehicle. The spring loading therefore advantageously takes care that after the occurrence of a crash and after the decaying of the vibrations caused by this crash, then the blocking member is transferred again into its release position such that the doors can be opened.

It is recommended to furnish two projections at the blocking member, wherein in each case one of these two projections in one of the two blocking positions engages mechanically with a counter projection. This allows to prevent that the blocking member becomes too far deflected in case of a crash and thus the undesired actuation of the handle is not avoided. The projections and counter projections can be formed differently as will be shown below.

Further embodiments and advantages of the invention result from the following description and the drawings. The subject matter of the invention is illustrated in the drawings in three embodiments.

Figure 2:
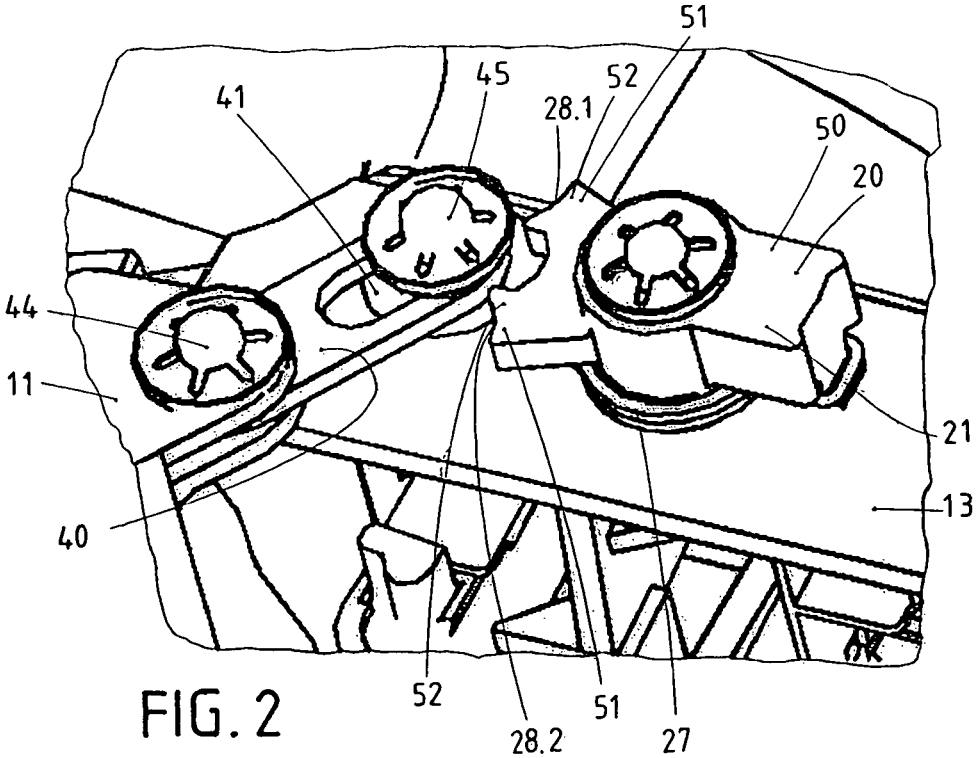
Figure 3:
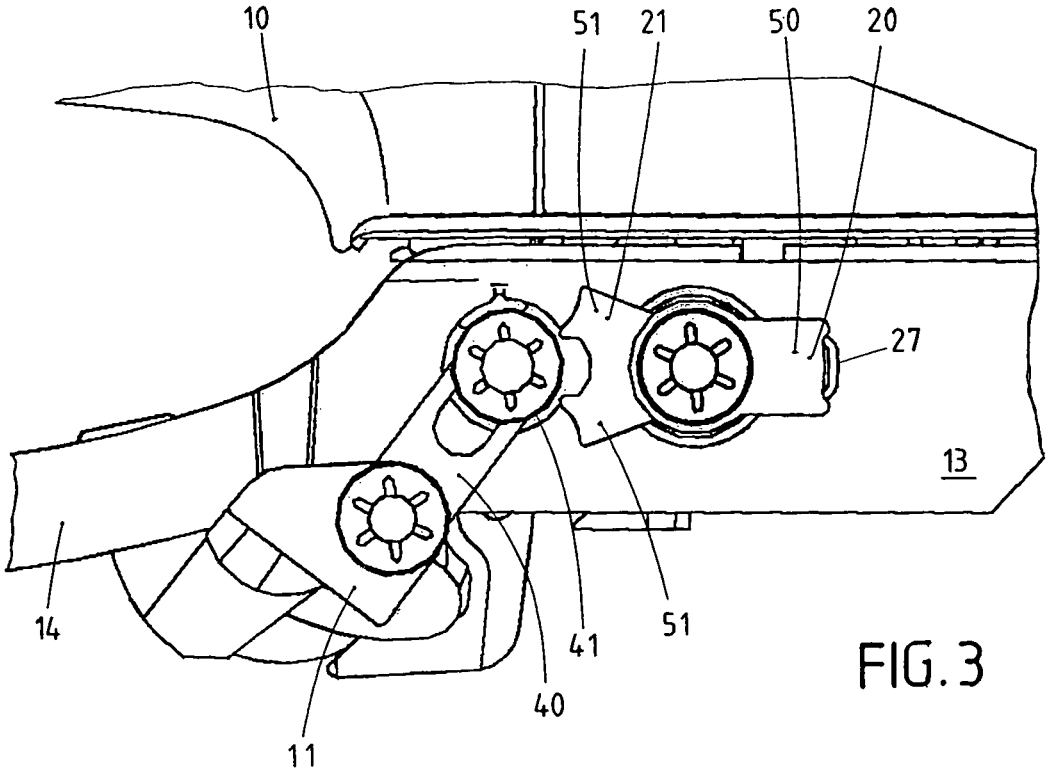
Figure 4:
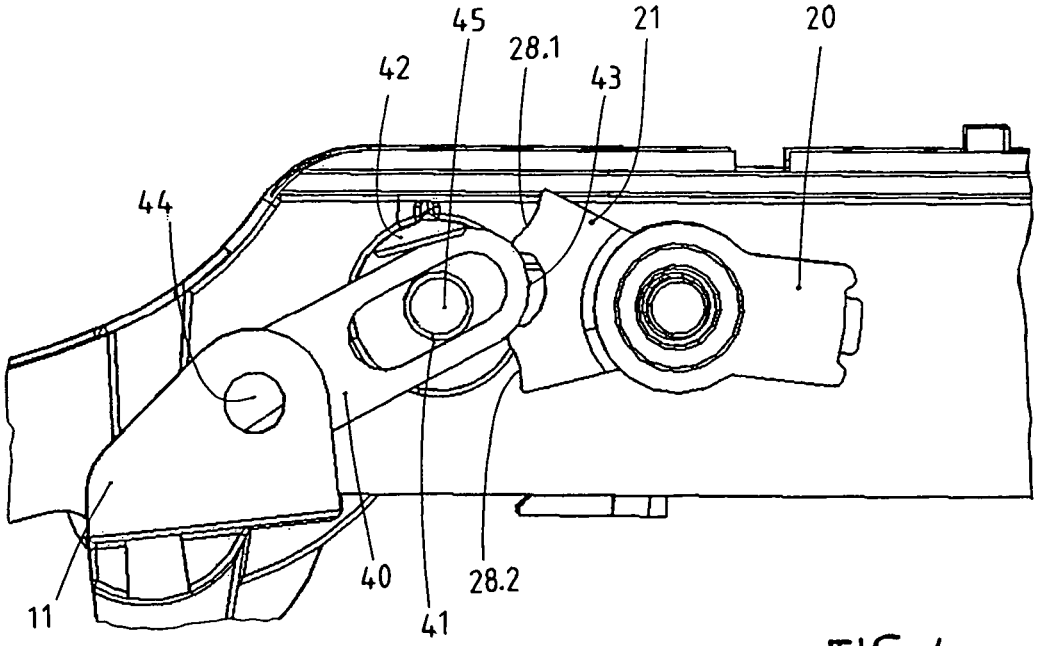
Figure 5:
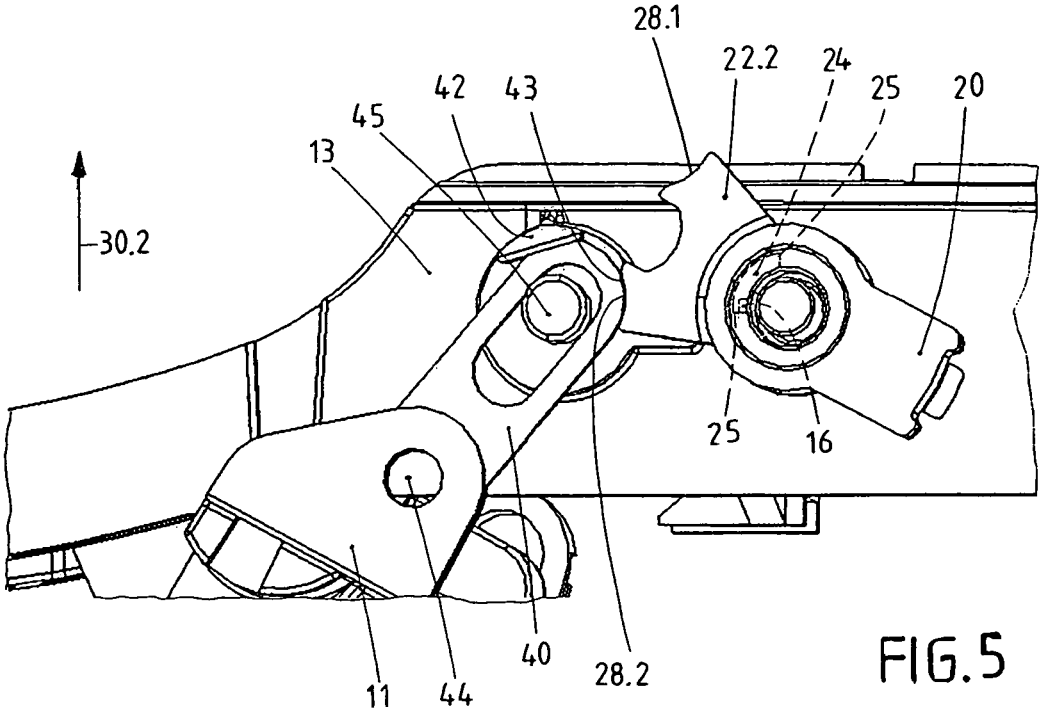
Figure 6:
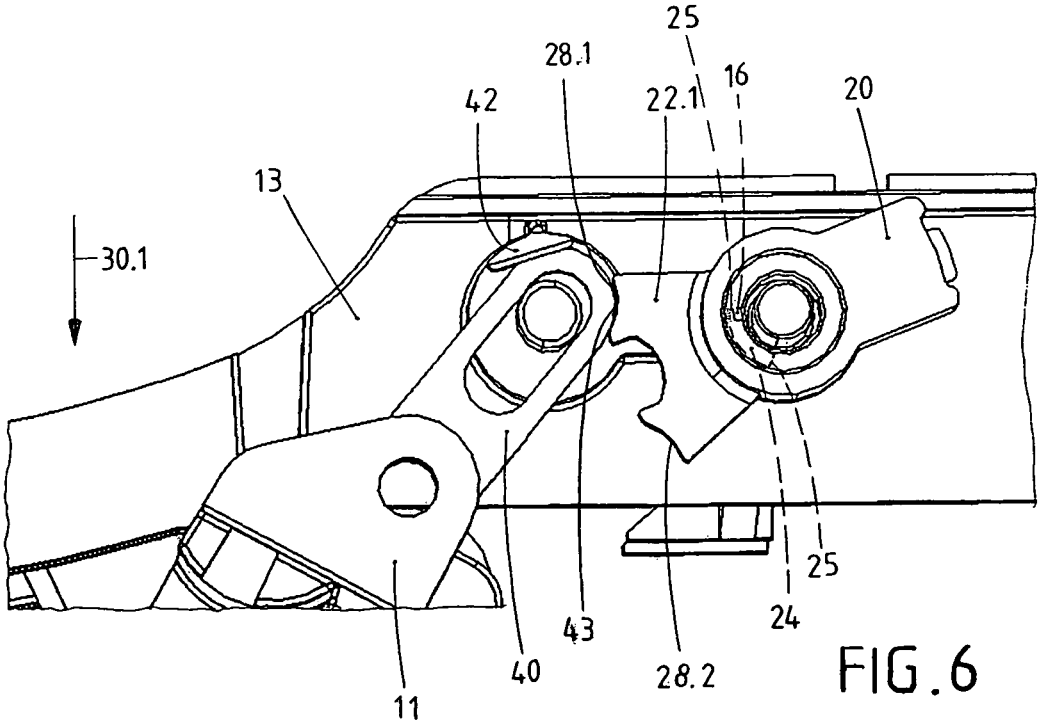
Figure 7:
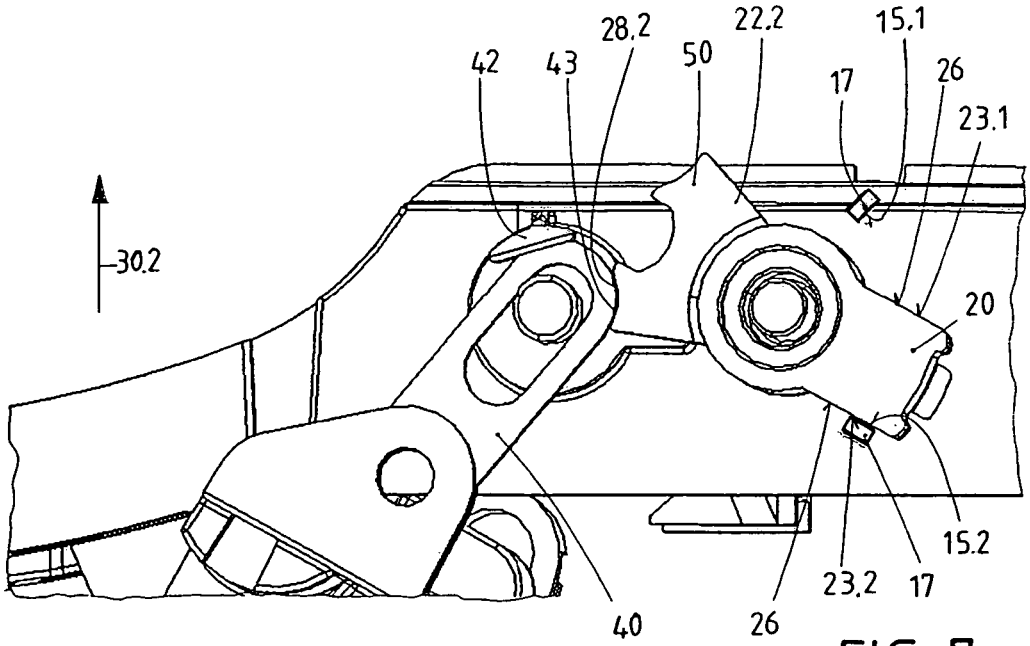
Figure 8:
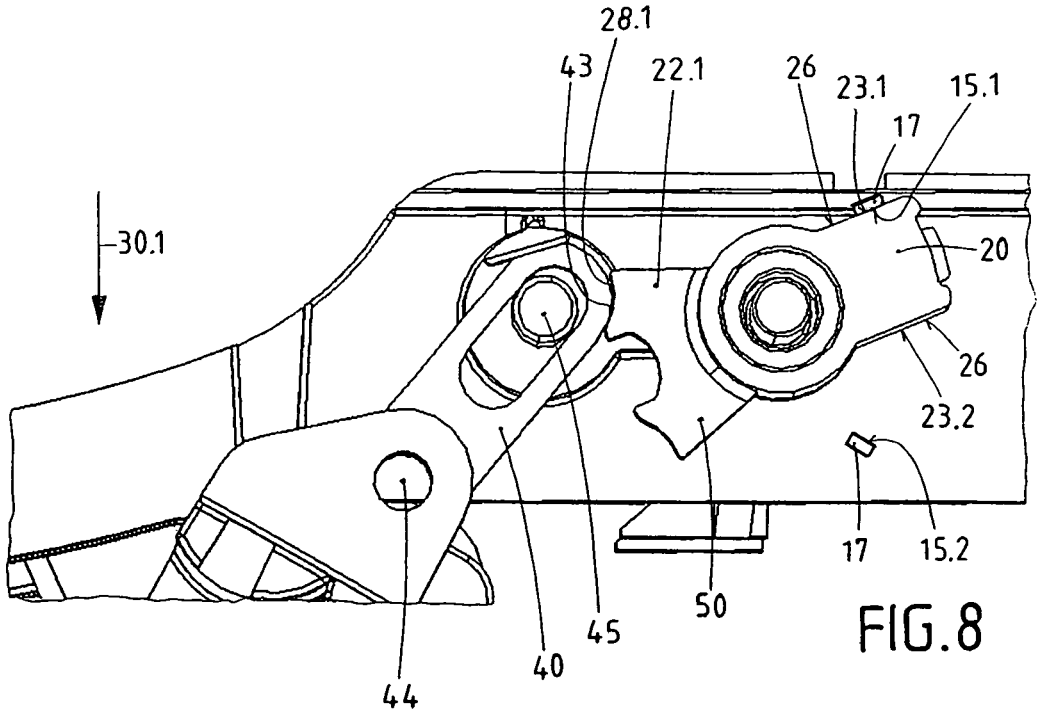
Figure 9A:
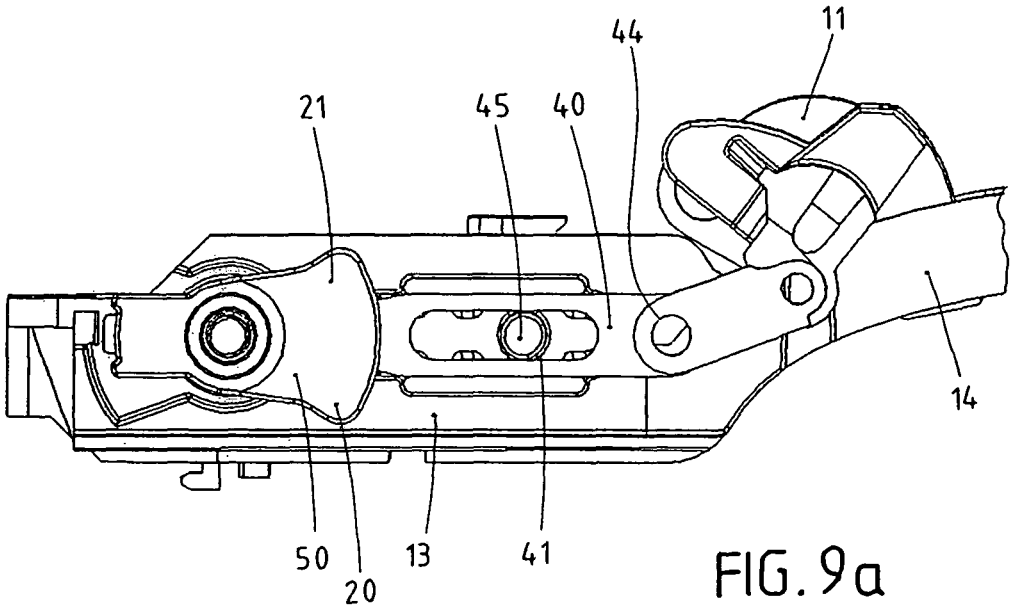
Figure 9B:
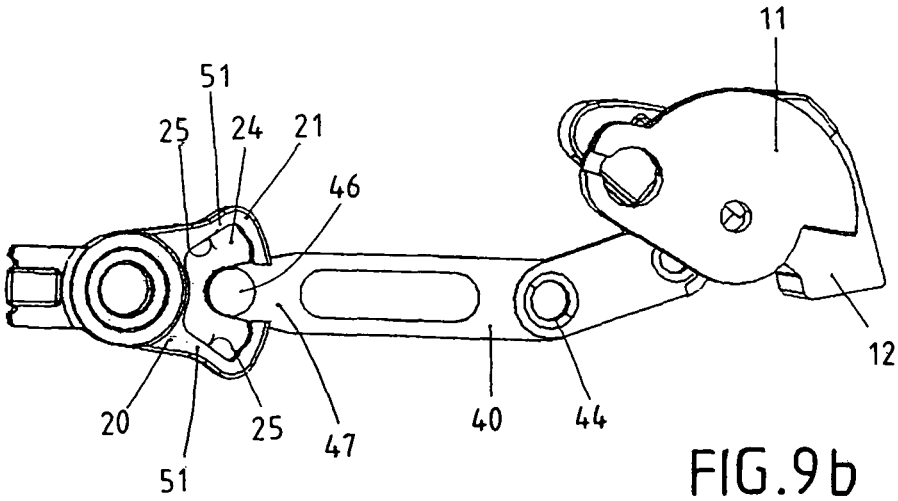
Figure 10A:
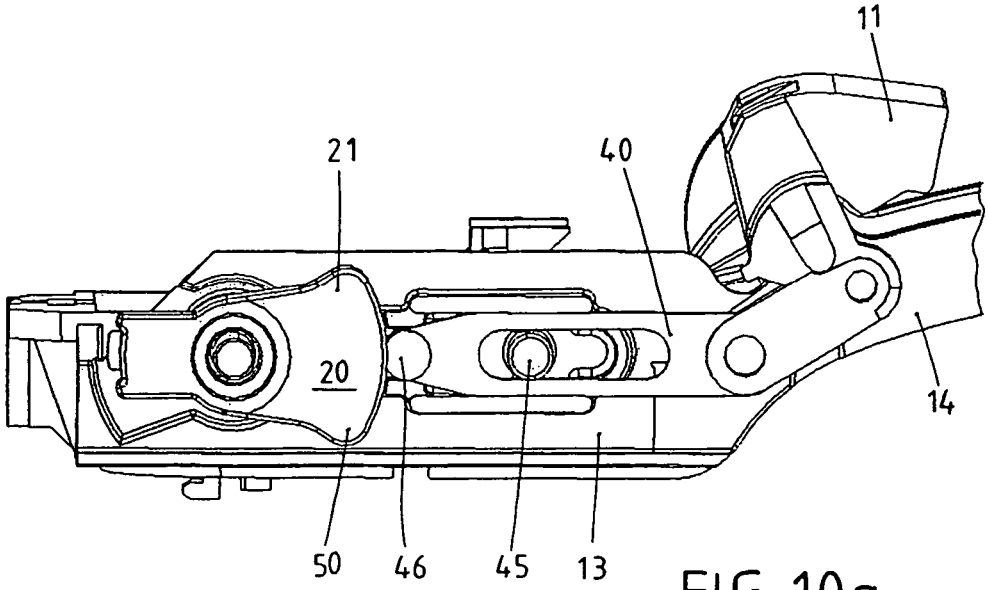
Figure 10B:
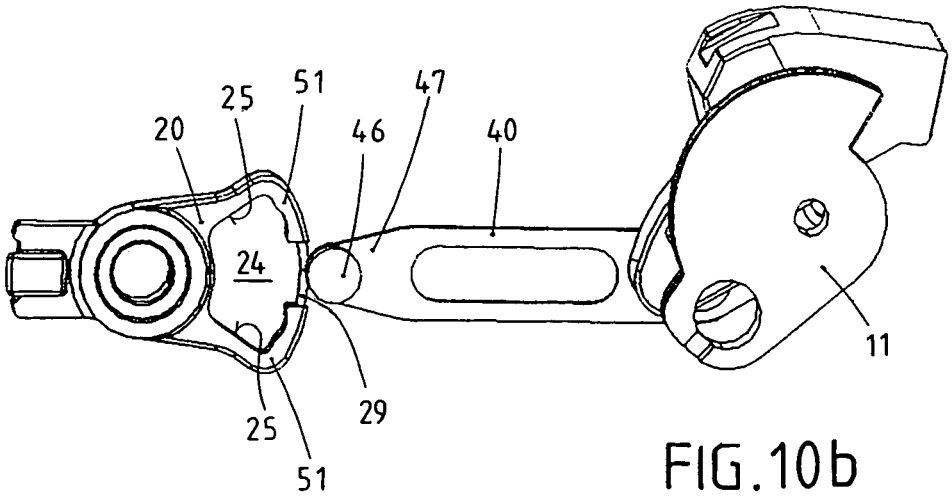
Figure 11A:
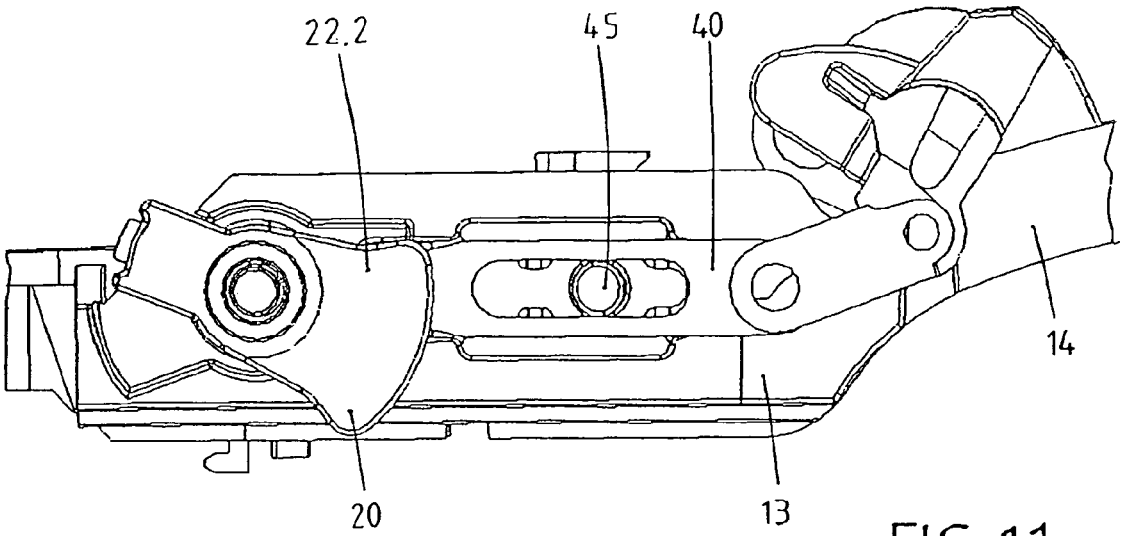
Figure 11B:
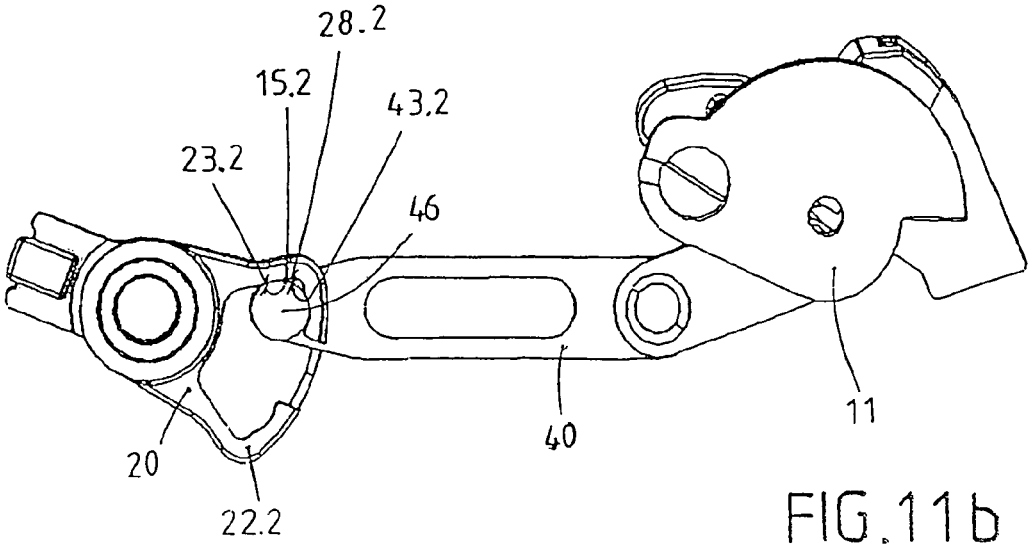
Figure 12A:
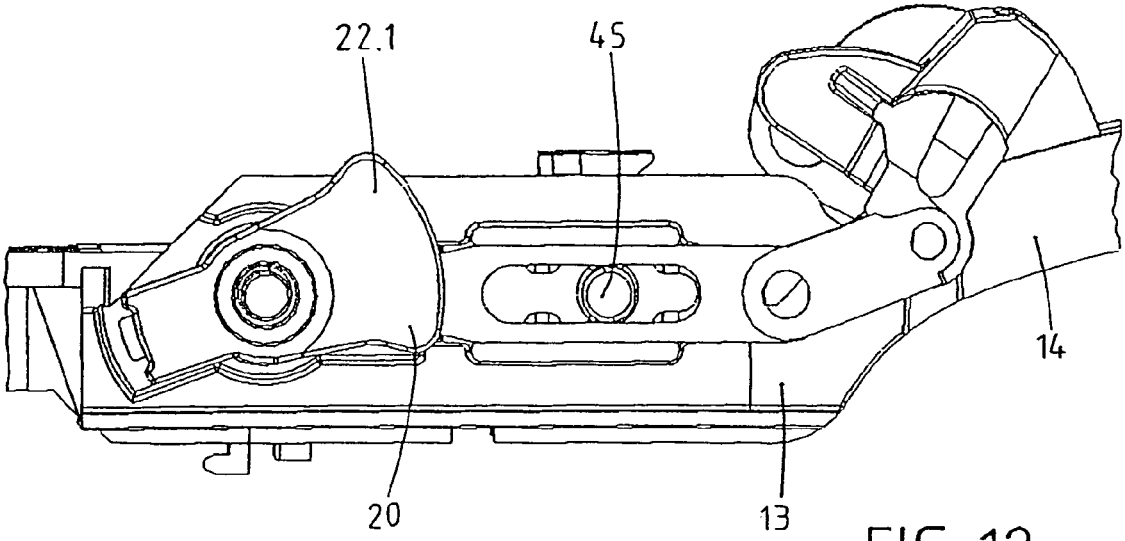
Figure 12B:
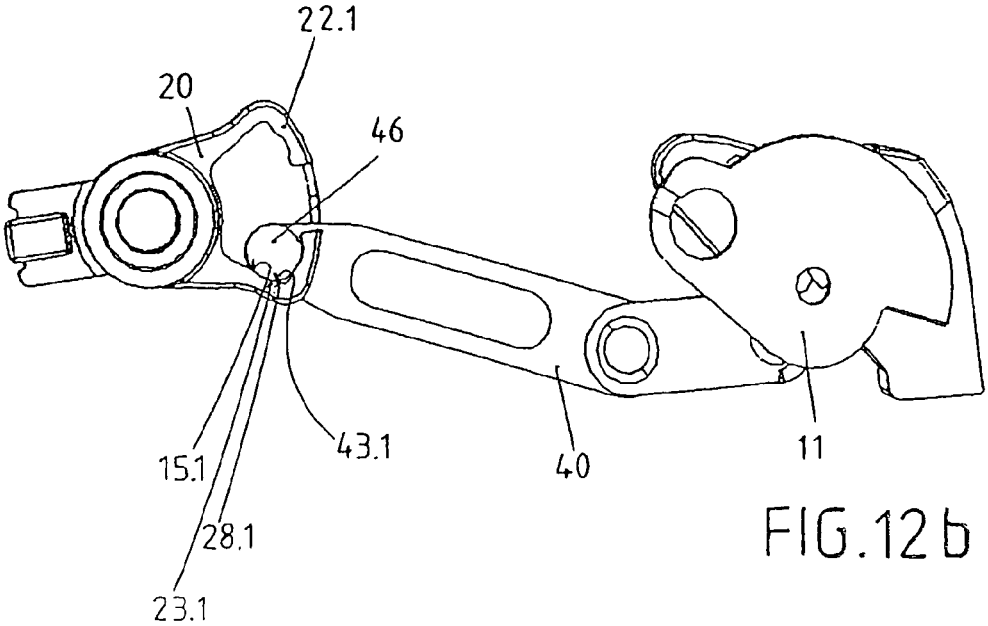
Figure 13:
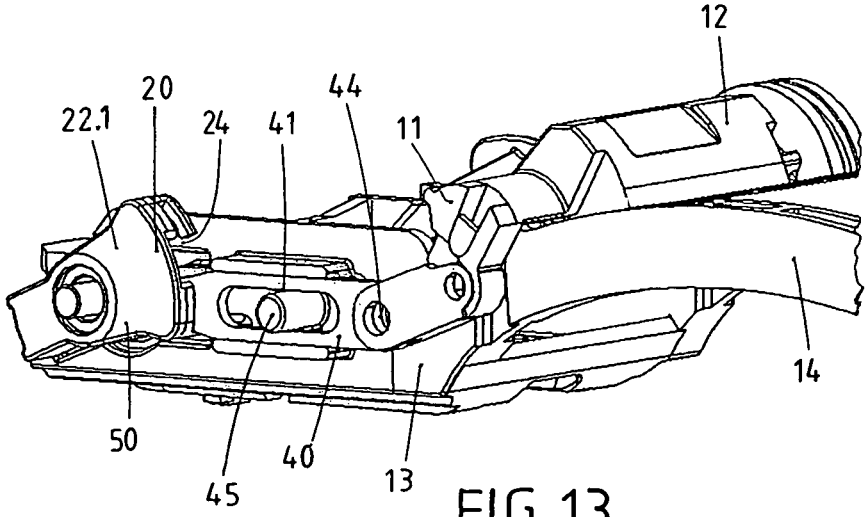
Figure 14:
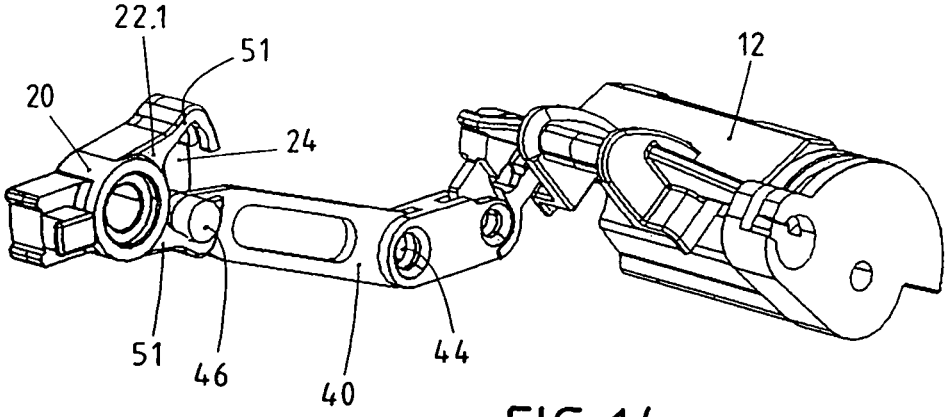

There is shown in:

FIG. 1 a perspective view according to a first embodiment of an outer door grip with handle, FIG. 2 an enlarged view of a part of FIG. 1, FIG. 3 a top planar view onto the outer door grip of FIG. 1 in release position, FIG. 4 a top planar view of the representation of FIG. 3 with removed coverings, FIG. 5 a view analogous to the view of FIG. 4, however in the second blocking position, FIG. 6 a view according to FIG. 5, however in the first blocking position, FIG. 7 a representation according to FIG. 5 of a second embodiment, FIG. 8 a representation according to FIG. 6 of the embodiment of FIG. 7, FIG. 9*a* a view of a further embodiment of the outer door grip of the present invention in a release position, FIG. 9*b* a different view of the outer door grip according to FIG. 9*a*, FIG. 10*a* a view of the outer door grip according to FIG. 9*a* upon actuation of the handle, FIG. 10*b* a view of the outer door grip according to FIG. 10*a* in a view according to FIG. 9*b*, FIG. 11*a* a view of the outer door grip according to FIG. 9*a* in a second blocking position, FIG. 11*b* a view of the outer door grip according to FIG. 11*a* in a view according to FIG. 9*b*, FIG. 12*a* a view of the outer door grip according to FIG. 9*a* in a first blocking position, FIG. 12*b* a view of the outer door grip according to FIG. 12*a* in a view according to FIG. 9*b*, FIG. 13 a perspective view of the outer door grip according to FIG. 9*a* in its first blocking position, FIG. 14 a second perspective view of the outer door grip according to FIG. 13 shown with path of the force transmission.

DESCRIPTION OF INVENTION AND PREFERRED EMBODIMENTS

FIG. 1 shows that the outer door grip with the handle 10. A mass balancing weight 12 is furnished and serves simultaneously as a co-moving element 11. The blocking the leaver 40 is pivotally hinged at the mass balancing weight 12. The bearing bow 14 serves as a fixed element 13. The other side of the blocking lever 40 is disposed in the connecting link guide 41 attached at the bearing bow 14. The blocking member 20 is also disposed at the bearing bow 14, which blocking member 20 is disposed 4 its release position 21. The spring 27 is disposed below the blocking member 20, wherein the spring 27 strives to hold the blocking member 20 in its release position 21. The spring 27 is formed such that it opposes the deflections of the blocking members 20 in two directions.

This can be recognized from FIG. 2 in some more detail. The blocking member 20 exhibits two limit stops 28.1 and 28.2. The blocking member 20 engages with the one of its limit stops 28.1, 28.2 with a counter limit stop 43 (FIG. 4) in an operational connection, which will be shown in more detail below. The blocking member 20 is itself here approximately Y-shaped 50. The limit stops 28.1, 28.2 are disposed at the ends 52 of the two Y-arms 51.

Also FIG. 3 and FIG. 4 show again the blocking member 20 in its release position 21. Since the cover caps were removed in the representation of FIG. 4, one clearly recognizes how the blocking lever 40, which is moved together with a normal actuation of the handle 10, impacts at the blocking member 20, in particular at the ends 52 of the Y-arms 51, and thus effects the light movement of the blocking member 20, which protects the blocking member 20 against seizing.

The blocking member 20 is shown in FIGS. 5 and 6 in its blocking positions 22.1, 22.2. The direction 30.1, 30.2 of an occurring crash is also shown by way of example, wherein the crash has led to the deflection of the blocking member 20 and therewith to the illustrated blocking position 22.1, 22.2. Of course the crash does not have to occur from exactly the illustrated direction in order to lead to the result shown. It I completely sufficient, if at least one part of the direction of motion of the crash is directed in the illustrated direction 30.1, 30.2.

It shows that one of the limit stops 28.1, 28.2 of the blocking member 20 in each of the blocking positions 22.1, 22.2 is in effective mechanical connection with a counter limit stop 43 at the blocking lever 40. Only one counter limit stop 43 exists for the two limit stops 28.1, 28.2 in the illustrated example. Of course there is also the possibility of furnishing a single limit stop 28.1, 28.2 and/or two counter limit stops 43 depending on an embodiment of the invention.

One recognizes also the recess 24 at the blocking member 20 as well as the tappet 16, which is disposed at the bearing bow 14. Projections 23.1, 23.2 form the sides 25 of the recess 24, which projections 23.1, 23.2 engage in a mechanical connection in the corresponding blocking position 22.1, 22.2 with the counter projections 15.1, 15.2 formed by the tappet 16. It is thereby prevented that the blocking member 20 is too far deflected by the deflection of the blocking member 20 caused by the crash such that the limit stops 28.1, 28.2 cannot any longer enter into an effective connection with the counter limit stop 43 at the blocking lever 40. Of course it is just the same possible to furnish the recess 24 at the bearing bow 14, while the blocking member 20 exhibits a tappet 16.

In addition, the functioning of the stopper 42 is clearly recognizable. The blocking lever 40 is pivotally supported at the co-moving element 11 and is guided at the fixed element 13 in a connecting link guide 41 and whereby the stopper 42 additionally takes care that the blocking lever 40 becomes wedged between the limit stop 28.1, 28.2 of the blocking member 20 and the stopper 42, such that a motion of the blocking lever 40 and therewith also of the handle 10 is not any longer possible in case of a crash. The forces induced by a crash and operating on the handle are thus picked up by the bearing position 44 of the blocking lever 40 at the co-moving element 11 and by the stopper 42 under co-action of the blocking member 20. Of course embodiments without a stopper 42 are possible. There the forces caused by the crash are picked up by the sliding block 45 of the connecting link guide 41 and the bearing position 44 of the blocking lever 40.

This can also be recognized from the FIGS. 7 and 8, wherein the blocking member 20 is also shown in its two blocking positions 22.1, 22.2. The single difference to the embodiment shown in the FIGS. 5 and 6 comprises that the projections 23.1. and 23.2, which prevent a too far deflection of the blocking member 20, are formed by the flanks 26 of the blocking member 20. In addition, also noses 17 are furnished, which noses 17 form the counter projections 15.1, 15.2 fitting to the projections 23.1, 23.2. The co-action of the projections 23.1, 23.2 and of the counter projections 15.1, 15.2 can be clearly recognized from FIGS. 7 and 8.

A third preferred embodiment of the invention is shown in FIGS. 9*a* to 14. The blocking member 20 can be recognized in the FIGS. 9*a* and 9*b*, which blocking member 20 is disposed in its release position 21. The blocking lever 40 in this state is freely movable in its connecting link guide 41. The motion of the blocking lever 40 performed here is a pure translation.

The handle 10 not illustrated here in detail is not actuated in the release position 21 illustrated in the FIGS. 9*a* and 9*b*. The blocking lever 40 protrudes with its end 47 and in particular with the cam 46 attached at the blocking lever 40 into a recess 24 between the arms 51 of the Y-shaped 50 blocking member 20. The cam 46 is aligned in this position with the opening 29 of the recess 24 at the blocking member 20 and the limit stops 28.1, 28.2 are furnished in this recess 24.

If the handle 10 is now actuated, then the situation shown in the FIGS. 10*a* and 10*b* is generated. The end 47 of the blocking lever 40 with the cam 46 attached thereto is pulled out through the opening 29 from the recess 24 of the blocking member 20. An opening of the vehicle door is possible this way.

The first and second blocking positions 22.1, 22.2 are shown in the FIGS. 12*a* and 12*b* or, respectively, FIGS. 11*a* and 11*b*. The cam 46 disposed at the end 47 of the blocking lever 40 is in this position not any longer aligned with the opening 29 of the recess 24. Instead the cam 46 remains caught in the recess 24. The sides 25 of the recess 24 here serve both as projections 23.1, 23.2 as well as also limit stops 28.1, 28.2. The counter projections 15.1, 15.2 are realized by the cam 46 of the blocking lever 40. Also two counter limit stops 43.1, 43.2 are provided in this embodiment example, wherein the counter limit stops 43.1, 43.2 are also disposed at the cam 46.

An unintentional movement of the handle 10 based on a vibration caused by the crash is not possible in the blocking positions 22.1, 22.2, since the motion of the blocking lever 40 is blocked by the blocking member 20, namely by having the cam 46 caught in the recess 24.

Finally, it is also pointed to FIGS. 13 and 14. These Figs. provide again an overview over the arrangement of the most important device components of the third embodiment; in particular the cooperation of blocking member 20, blocking lever 40 and mass balancing weight 12 becomes clear in FIG. 14. Therefore, it can be clearly recognized that in the there presented first blocking position 22.1 an unintended and inadvertent actuation of the handle 10 is not possible.

A particular advantage associated with this embodiment comprises that no different device components are required for the limit stops 28.1, 28.2 as well as for the projections 23.1, 23.2. The same holds for the counter limit stops 43.1, 43.2 and for the counter projections 15.1, 15.2. The outer door grip according to the third embodiment of the invention is thereby produced particularly simple and cost favorable.

Features of the Invention

An outer door grip for vehicles comprises a fixed element (13), a blocking member (20) pivotally mounted on the fixed element (13) and having a release position (21), a first blocking position (22.1), and a second blocking position (22.2), a hinge (44) supported by a co-moving element (11), a blocking lever (40) pivotally mounted on the co-moving element (11) by the hinge (44) and engaging the blocking member (20) in the release position (21), the first blocking position (22.1), and the second blocking position (22.2). A connecting link guide (41) is disposed at the blocking lever (40) and a sliding block (45) engages the connecting link guide (41).

In a usual situation the blocking lever (40) is movable upon a standard actuation of the handle (10). The motion of the blocking lever (40) is blocked by the blocking member (20), where the blocking member (20) is disposed in one of its blocking positions (22.1, 22.2). The blocking lever (40) is blocked only by the blocking member (20) in the blocking positions (22.1, 22.2) and without an intermediate positioning of further device components. The blocking member (20) in each of its blocking positions (22.1, 22.2) wedges the blocking lever (40) with the aid of the stopper (42) and therefore prevents a motion of the blocking lever (40). The blocking lever (40) is disposed at a co-moving element (11), which moves, upon actuation of the handle (10), with the handle (10), and wherein a Bowden cable or a rod for actuating the lock are arranged at the co-moving element (11). The blocking member (20) is spring (27) loaded, wherein the spring (27) loading takes care that the blocking member (20) remains in a normal situation in its release position (21) and/or the blocking member (20) is moved to a slight extent upon a normal actuation of the handle (10). One or several mass balancing weights (12) are furnished, which mass balancing weights (12) take care of mass balancing in case of a crash, wherein in particular a mass balancing weight (12) serves as a co-moving element (11). The blocking member (20) is disposed on a fixed element (13) such as a bearing bow (14) or a grip carrier.

Two projections (23.1,23.2) are furnished at the blocking member (20), wherein in each case one of the projections (23.1, 23.2) in one of the blocking positions (22.1, 22.2) enters with one counter projection (15.1, 15.2) into an effective connection. The projections (23.1, 23.2) and the counter projections (15.1, 15.2) are formed by the sides (25) of a recess (24) and by a tappet (16), wherein the one device component, either the recess (24) or the tappet (16), moves with the blocking member (20), while the other device component is arranged at the fixed element (13). The projections (23.1, 23.2) are formed by the flanks (26) of the blocking member (20), and the counter projections (15.1, 15.2) are formed by noses (17). The projections (23.1, 23.2) are formed by the sides (25) of a recess (24) at the blocking member (20), while the counter projections (15.1, 15.2) are formed by a cam (46) at the blocking lever (40). The cam (46) is disposed at one end (47) of the blocking lever (40) and the cam (46) is aligned with an opening (29) at the recess (24) while in the release position (21) of the blocking member (20) and this way the cam (46) is movable out of this opening (29), wherein however the cam (46) is not any longer aligned with the opening (29) in one of the blocking positions (22.1, 22.2) of the blocking member (20) and this way the cam (46) becomes caught in the recess (24). The blocking member (20) exhibits two limit stops (28.1, 28.2), wherein the blocking member (20) in each of its blocking positions (22.1, 22.2) with its limit stops (28.1, 28.2) enters into an effective connection with a counter limit stop (43, 43.1, 43.2) at the handle (10), at the co-moving element (11), or at the blocking lever (40). The projections (23.1, 23.2) and the counter projections (15.1, 15.2) serve simultaneously as limit stops (28.1, 28.2) and counter limit stops (43.1, 43.2).

A method of securing an outer door grip comprises furnishing a fixed element (13), pivotally mounting a blocking member (20) on the fixed element (13), establishing a release position (21), a first blocking position (22.1), and a second blocking position (22.2) for the blocking member (20), and thereby providing two blocking positions (22.1, 22.2), supporting a hinge (44) by a co-moving element (11), pivotally mounting a blocking lever (40) on the co-moving element (11) by way of the hinge (44), engaging the blocking member (20) in the release position (21), the first blocking position (22.1), and the second blocking position (22.2) with the blocking lever (40), disposing a connecting link guide (41) at the blocking lever (40), and engaging the connecting link guide (41) with a sliding block (45).

A handle (10) can be manually actuated and thereby a lock disposed in a door can be operated. The pivotally mounted blocking member (20) in its normally ineffective release position (21) can be actuated and thereby enable movement of the handle (10). The door can be crashed with a crash coming from a first direction (30.1). The blocking member (20) can pass into a first effective release position (22.1) and thereby blocking the handle (10). The door can be crashed with a crash coming from a second direction (30.2) disposed about opposite to the first direction (30.1). The blocking member (20) can pass into a second effective blocking position (22.2) and thereby blocking the handle (10). The handle (10) can be blocked by the blocking member (20) in its blocking position (22.1, 22.2) under intermediate switching and positioning of the blocking lever (40). The blocking lever (40) can be guided in a kind of the connecting link guide (41). The blocking lever (40) can be moved in case of a usual actuation of the handle (10).

A motion of the blocking lever (40) can be blocked by the blocking member (20) while the blocking member (20) is disposed in one of the blocking positions (22.1, 22.2).

In conclusion it is pointed out that the embodiments here illustrated are only realizations of the invention by way of example. The invention is not limited to the examples. On the contrary, multiple modifications and changes are possible. Therefore for example the blocking member 20 can exhibit only one Y-arm or, respectively, can be constructed in a different way. It is also possible that the blocking member 20 is associated with a single blocking position or only blocks in a single crash direction.

LIST OF REFERENCE CHARACTERS

10 handle
11 co-moving element
12 mass balancing weight
13 fixed element
14 bearing bow
15.1 first counter projection
15.2 second counter projection
16 tappet
17 nose
20 blocking member
21 release position
22.1 first blocking position
22.2 second blocking position
23.1 first projection at blocking member 20
23.2 second projection at blocking member 20
24 recess
25 side of recess 24
26 flank of blocking member 20
27 spring
28.1 first limit stop of blocking member 20
28.2 second limit stop of blocking member 20
29 opening at recess 24
30.1 first direction of a crash
30.2 second direction of a crash
40 blocking lever
41 connecting link guide
42 stopper
43 counter limit stop
43.1 first counter limit stop (FIG. 11*a*-12*b*)
43.2 second counter limit stop (FIG. 11*a*-12*b*)
44 bearing position of blocking lever 40 at co-moving element 11
45 sliding block
46 cam
47 end of blocking lever 40
50 Y-form
51 arm
52 end region of blocking lever 40

The invention claimed is:

1. An outer door grip, for vehicles, said outer door grip comprising a manually actuatable handle (10), which handle can activate a lock present in a door upon actuation;

a mass balancing weight (12);

a blocking lever (40) pivotally hinged at the mass balancing weight (12);

a pivotal blocking member (20) approximately Y-shaped (50) forming a first Y-arm (51) having an end (52) and a second Y-arm (51) having an end (52) and formed separate from the first Y-arm (51), which pivotal blocking member (20) is normally disposed in its ineffective release position (21) and thereby allows to actuate the handle (10), which blocking member (20) can assume a first blocking position (22.1) associated with the end (52) of the first Y-arm (51) forming a first limit stop 28.1 and a second blocking position (22.2) associated with the end (52) of the second Y-arm (51) forming a second limit stop (28.2);

wherein the blocking member (20) passes into the first blocking position (22.1) upon a crash out of a first direction (30.1);

wherein the blocking member (20) passes into the second blocking position (22.2) upon a crash out of a second direction (30.2);

wherein the blocking member (20) after assumption of a blocking position (22.1, 22.2) blocks the handle (10) under intermediate switching and positioning of the blocking lever (40);

a connecting link guide (41) wherein the blocking lever (40) is guided in the connecting link guide (41).

2. The outer door grip according to claim 1, wherein in a usual situation the blocking lever (40) is movable upon a standard actuation of the handle (10) and wherein the motion of the blocking lever (40) is blocked by the blocking member (20), where the blocking member (20) is disposed in one of its blocking positions (22.1, 22.2).

3. The outer door grip according to claim 1, wherein the blocking lever (40) is blocked only by the blocking member (20) in the blocking positions (22.1, 22.2) and without an intermediate positioning of further device components.

4. The outer door grip according to claim 1 further comprising a stopper (42), wherein the blocking member (20) in each of its blocking positions (22.1, 22.2) wedges the blocking lever (40) with the aid of the stopper (42) and therefore prevents a motion of the blocking lever (40).

5. The outer door grip according to claim 1, wherein the blocking lever (40) is disposed at a co-moving element (11), which moves upon actuation of the handle (10) with the handle (10), and wherein a Bowden cable or a rod for actuating the lock are arranged at the co-moving element (11).

6. The outer door grip according to claim 1, wherein the blocking member (20) is spring (27) loaded, wherein the spring (27) loading takes care that the blocking member (20) remains in a normal situation in its release position (21) and/or the blocking member (20) is moved to a slight extent upon a normal actuation of the handle (10).

7. The outer door grip according to claim 1, wherein one or several mass balancing weights (12) are furnished, which mass balancing weights (12) take care of mass balancing in case of a crash, wherein a mass balancing weight (12) serves as a co-moving element (11).

8. The outer door grip according to claim 1, wherein the blocking member (20) is disposed on a bearing bow (14) or a grip carrier.

* * * * *